US011912381B2

(12) United States Patent
Fujimoto

(10) Patent No.: US 11,912,381 B2
(45) Date of Patent: Feb. 27, 2024

(54) SWIMMING MASK

(71) Applicant: TABATA CO., LTD., Tokyo (JP)

(72) Inventor: Takashi Fujimoto, Tokyo (JP)

(73) Assignee: TABATA CO., LTD., Tokyo (JP)

( * ) Notice: Subject to any disclaimer, the term of this patent is extended or adjusted under 35 U.S.C. 154(b) by 151 days.

(21) Appl. No.: 17/483,814

(22) Filed: Sep. 24, 2021

(65) Prior Publication Data

US 2022/0097811 A1 Mar. 31, 2022

(30) Foreign Application Priority Data

Sep. 25, 2020 (JP) ..... 2020-161476

(51) Int. Cl.
*B63C 11/12* (2006.01)

(52) U.S. Cl.
CPC ..... *B63C 11/12* (2013.01); *B63C 2011/128* (2013.01)

(58) Field of Classification Search
CPC ..... A61F 9/027; A63B 33/002; A63B 33/004; B63C 11/12; B63C 2011/128
See application file for complete search history.

(56) References Cited

U.S. PATENT DOCUMENTS 3,606,648 A * 9/1971 Schuler ..... B63C 11/12 2/452
6,131,246 A * 10/2000 Paulson ..... A61F 9/027 24/3.3
6,350,030 B2 * 2/2002 Fujima ..... B63C 11/12 351/43
7,134,149 B2 * 11/2006 Sato ..... B63C 11/12 2/431
7,146,653 B2 * 12/2006 Chou ..... A63B 33/004 24/636
7,185,373 B2 * 3/2007 Chiang ..... A63B 33/004 2/452
7,251,842 B1 * 8/2007 Chiang ..... A63B 33/004 2/452
7,665,190 B2 * 2/2010 Weng ..... A63B 33/002 2/426
8,042,199 B2 * 10/2011 Chiang ..... A63B 33/004 2/448
8,117,680 B1 * 2/2012 Chou ..... A63B 33/004 2/452
8,286,271 B2 * 10/2012 Chiang ..... A63B 33/004 2/448
8,312,603 B2 * 11/2012 Chou ..... A63B 33/004 24/191
8,407,820 B1 * 4/2013 Chou ..... A63B 33/004 2/448

(Continued)

FOREIGN PATENT DOCUMENTS

DE 29609285 U1 * 10/1996 ..... A63B 33/002
JP 2004-136057 A 5/2004

*Primary Examiner* — F Griffin Hall
(74) *Attorney, Agent, or Firm* — HAUPTMAN HAM, LLP

(57) ABSTRACT

The buckle of the swimming mask includes a front end portion attached to a connecting unit, a rear end portion including an insertion portion in which the head strap is inserted, and an intermediate portion between the front end portion and the rear end portion. The wound portion around which the head strap is wound in the reversible manner is disposed in the intermediate portion.

14 Claims, 9 Drawing Sheets

(56) References Cited

U.S. PATENT DOCUMENTS

| | | | | |
|---|---|---|---|---|
| 8,707,522 | B2 * | 4/2014 | Shiue | A63B 33/002 24/593.11 |
| 8,959,670 | B2 * | 2/2015 | Chiang | A63B 33/004 2/442 |
| 9,009,872 | B2 * | 4/2015 | Chiang | A63B 33/004 2/426 |
| 9,241,542 | B2 * | 1/2016 | Kuo | A63B 33/004 |
| 10,137,036 | B2 * | 11/2018 | Fujimoto | B63C 11/12 |
| 2009/0193633 | A1 * | 8/2009 | Shiue | B63C 11/12 24/69 TS |
| 2012/0096632 | A1 * | 4/2012 | Chou | A63B 33/004 2/452 |
| 2012/0160989 | A1 * | 6/2012 | Yasuhara | A63B 33/004 248/693 |

* cited by examiner

SWIMMING MASK

RELATED APPLICATIONS

The present application claims priority based on Japanese Patent Application No. 2020-161476, filed Sep. 25, 2020, the disclosure of which is hereby incorporated by reference herein in its entirety.

BACKGROUND OF THE INVENTION

The present invention relates to a swimming mask including a buckle for connecting a strap to a mask body.

The swimming mask including the buckle for connecting the strap to the mask body has been conventionally known. For example, JP-A-2004-136057 discloses a swimming mask including: a mask body including a lens frame for fixing a lens and a skirt extending rearward from the lens frame; and a buckle for connecting a strap to the mask body.

SUMMARY OF THE INVENTION

In a swimming mask disclosed in JP-A-2004-136057, a buckle has an adjuster function capable of adjusting a length of a strap so that the length of the strap can be adjusted to fit a size of a head of a wearer as appropriate.

However, a wound portion of the buckle around which an end portion of a head strap is wound is disposed at a rear of the buckle and exposed outside, and thus hair of the wearer may be entangled with the wound portion.

An object of the present invention is to improve the conventional swimming mask to provide a swimming mask including a buckle that can prevent entanglement of the hair of the wearer with a wound portion around which a head strap is wound in a reversible manner.

In order to achieve the object, the present invention is directed to a swimming mask having a front-back direction and a transverse direction, and including a mask body having a lens frame and a skirt extending rearward from the lens frame, and a head strap configured to be connected to the mask body via a buckle attached to a connecting unit disposed at least on one of both sides of the mask body.

In the swimming mask according to the present invention, the buckle incudes a front end portion attached to the connecting unit, a rear end portion including an insertion portion for inserting the head strap, and an intermediate portion between the front end portion and the rear end portion. A wound portion around which the head strap is wound in a reversible manner is disposed in the intermediate portion.

Embodiments described below relate to the swimming mask shown in FIGS. 1 to 9, and include both optional and preferable features as well as essential features of the present invention.

(1) The wound portion is disposed inside the buckle, and is not exposed outside.

(2) The buckle and the head strap are connected by a ratchet mechanism including an engagement tooth of the buckle and an engagement recess of the head strap. The engagement recess is disposed in an outer surface of the head strap, not on a face side of the wearer in a wearing state.

(3) The buckle further includes a stopper including a main body portion having the engagement tooth, and an operating member configured to release the engagement of the ratchet mechanism. The operating member includes operating portions separated in a vertical direction. Inclined surfaces disposed on undersurfaces of the operating portions and sliders on both ends of the main body portion make sliding contact so that the stopper moves in a direction separating from the head strap to release the engagement of the ratchet mechanism.

In the swimming mask according to the present invention, since the wound portion around which the head strap is wound in the reversible manner is disposed in the intermediate portion of the buckle, the hair of the wearer does not easily reach the wound portion, and thus entanglement of the hair of the wearer with the wound portion can be prevented.

BRIEF DESCRIPTION OF DRAWINGS

The drawings illustrate specific embodiments of a swimming mask according to the present invention including optional and preferred embodiments as well as essential features of the invention.

DESCRIPTION OF EMBODIMENTS

Figure 1:
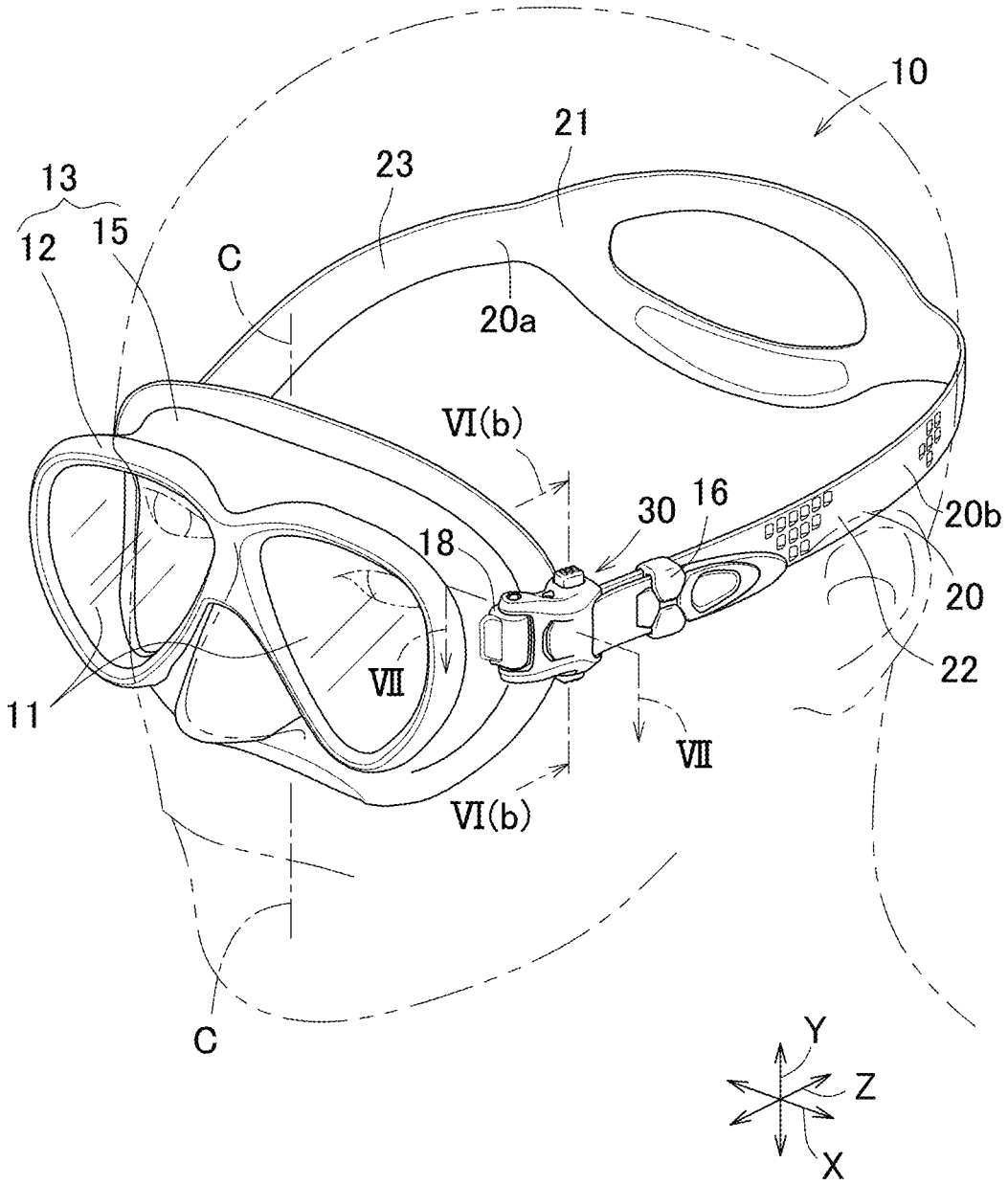
FIG. 1 is a perspective view of a swimming mask according to the present invention.

Referring to the accompanying drawings, details of a swimming mask 10 according to the present invention are described as follows. In FIG. 1, a front-back direction of the swimming mask 10 is represented by Z, a vertical direction by Y, and a width direction by X. A line C-C represents an imaginary center line bisecting a dimension of the swimming mask 10 in the width direction. The swimming mask 10 is symmetrical with respect to the imaginary centerline C-C. Inward (inside) in the width direction X means a direction toward the imaginary center line C-C, and outward (outside) in the width direction X means a direction opposite to the inward direction.

As shown in FIGS. 1 and 2, the swimming mask 10 includes a mask body 13 including a lens frame 12 in which a pair of lenses 11 are fixed and a flexible skirt 15 extending rearward from the lens frame 12, a head strap 20, and buckles 30 configured to connect the mask body 13 to the head strap 20. In an example shown in the drawings, the pair of lenses 11 include a pair of transparent plates, but one continuous transparent plate may be used. The swimming mask 10 further includes, as an option, a figure eight ring (a slider) 16 configured to prevent distal end portions 22A and 23A of the head strap 20 from flapping.

The lens frame 12 and the buckles 30 are made of a rigid plastic material. On the other hand, the skirt 15 and the head strap 20 are made of a soft material such as a natural or synthetic rubber, a silicone resin, or a thermoplastic synthetic resin.

Connecting units 18 configured to connect the buckles 30 to the mask body 13 are disposed on both sides of the skirt 15, not of the lens frame, in the mask body 13. With such an arrangement configuration of the buckles 30, when the swimming mask 10 is worn, and rearward tensile force caused by the head strap 20 is applied to the mask body 13 via the buckles 30, the lens frame 12 does not move rearward toward the face. This can prevent pressure in the swimming mask 10 from becoming more negative than required.

Figure 4A:
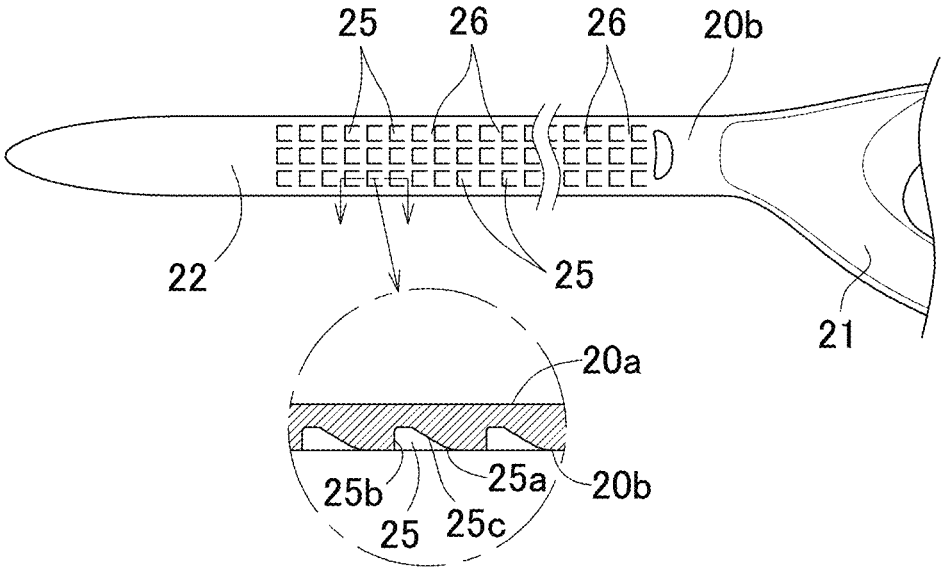
FIG. 4A is a plan view of a head strap seen from outside.
Figure 4B:
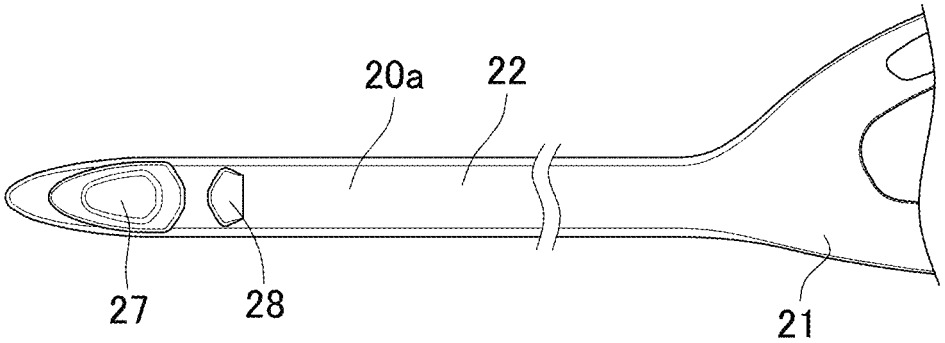
FIG. 4B is a view of a distal end portion of the head strap in a reverse state.

Referring to FIGS. 4A and 4B, the head strap 20 includes a bifurcated center portion 21 to be brought into contact with a back of a head of a wearer, and first and second extending portions 22 and 23 on both sides of the center portion 21. The head strap 20 includes an inner surface 20*a* that faces the face of the wearer, and an outer surface 20*b* on the opposite side of the inner surface 20*a*.

The outer surface 20*b* of each of the first and second extending portions 22 and 23 includes a plurality of engagement recesses 25 arranged at intervals in a length direction and a width direction of the head strap 20, and a flat portion 26 among the plurality of engagement recesses 25. That is, the flat portion 26 is a portion where the plurality of engagement recesses 25 are not formed in the outer surface of the head strap 20. In addition, the inner surface of the head strap 20 on a distal end side includes a first protrusion 27 and a second protrusion 28 in a protruding curved shape.

Furthermore, the first and second extending portions 22 and 23 are adjacent to the center portion 21 when the first and second extending portions 22 and 23 are in a reverse state via wound portions 63 of the buckles 30, and include base end portions 22B and 23B on a face side of the wearer and distal end portions 22A and 23A facing the base end portions 22B and 23B. The following description includes only the first extending portion 22 of the first and second extending portions 22 and 23 of the head strap 20, and one of the buckles 30. However, the second extending portion 23 has the same configuration. Alternatively, the buckle 30 may be attached to only one of the first and second extending portions 22 and 23 of the head strap 20 as needed.

Figure 2A:
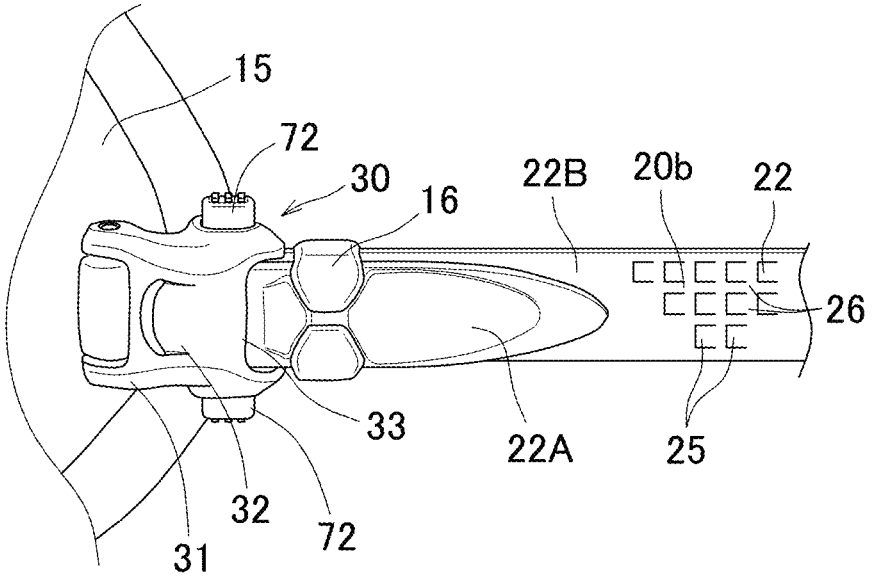
FIG. 2A is a side view of a buckle.
Figure 2B:
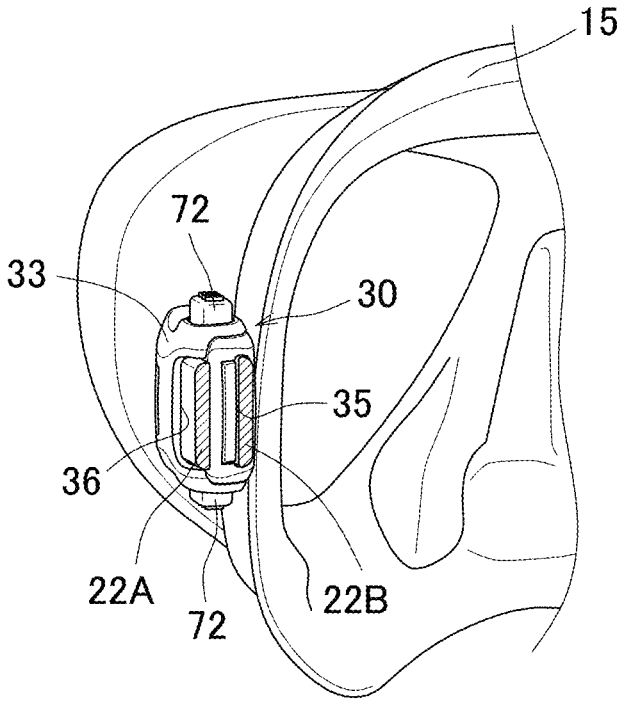
FIG. 2B is a rear view of the buckle.

Referring to FIGS. 2A and 2B, the buckle 30 includes an outer surface, an inner surface that faces the face of the wearer, a front end portion 31 attached to the connecting unit 18 in a pivotable manner, a rear end portion 33 including inner and outer insertion portions (insertion portions) 35 and 36 for inserting the head strap 20, and an intermediate portion 32 between the front end portion 31 and the rear end portion 33. The rear end portion 33 of the buckle includes a pair of operating portions 72 opposed to each other in the vertical direction Y. The rear end portion 33 also includes the inner insertion portion 35 in which the base end portion 22B of the head strap 20 is inserted and the outer insertion portion 36 in which the distal end portion 22A is inserted.

Figure 7A:
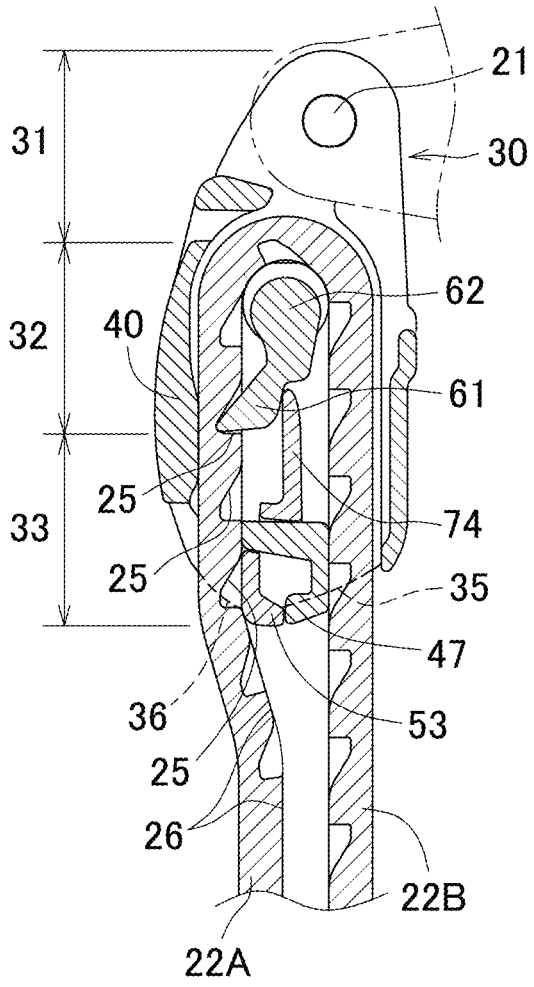
FIG. 7A is a cross-sectional view taken along line VII-VII in FIG. 1 in a locked state.

The wound portion 63 for reversing the head strap 20 is disposed inside the intermediate portion 32 of the buckle 30. As shown in FIG. 7A, the front end portion 31, rear end portion 33, and intermediate portion 32 are defined by dividing a dimension of the buckle 30 in the front-back direction Z into three equivalent parts, and the wound portion 63 is preferably disposed on a side of the front end portion 31 in the buckle 30.

Figure 3:
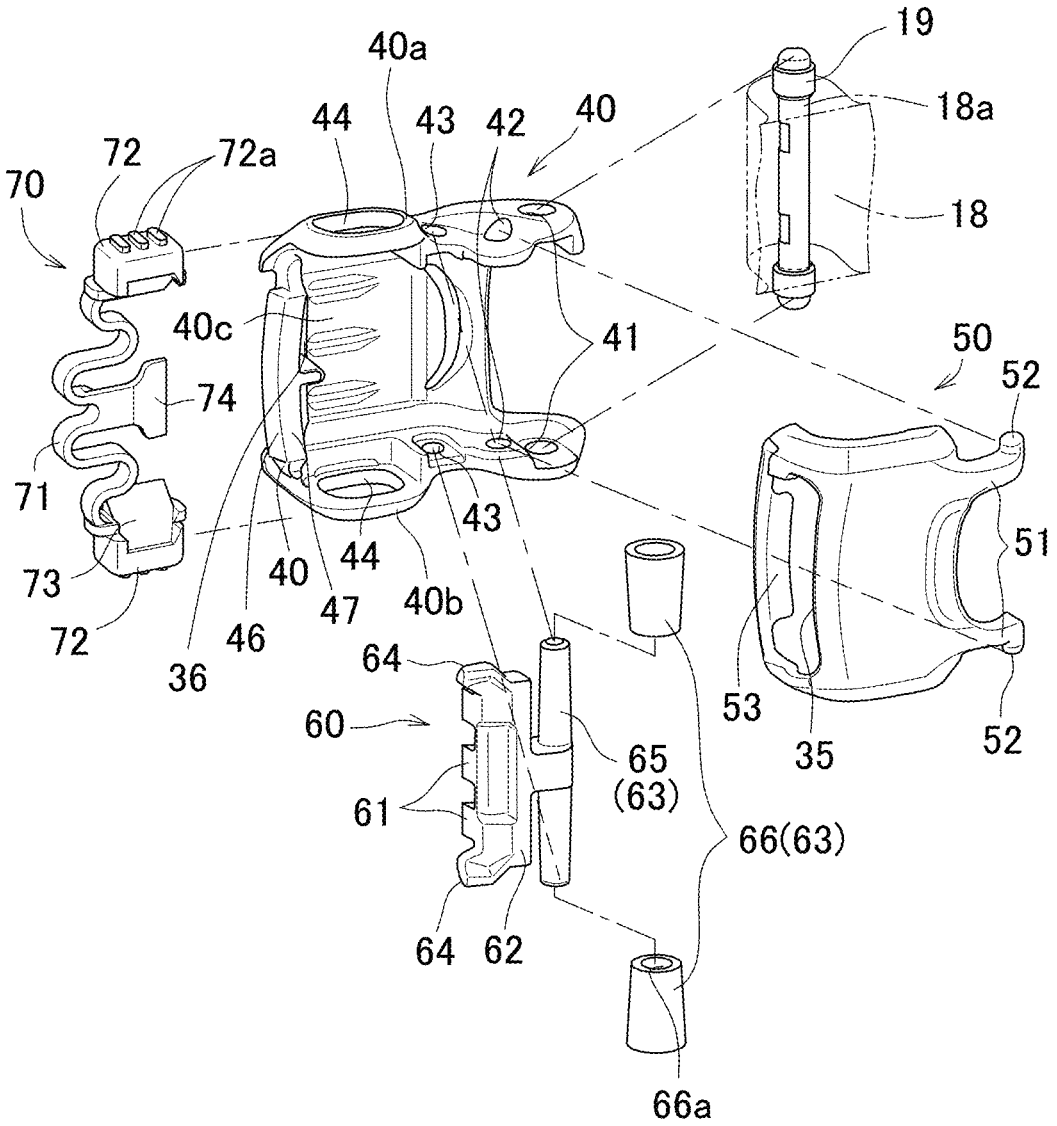
FIG. 3 is an exploded perspective view of the buckle.

Referring to FIG. 3, the buckle 30 includes a buckle body 40 to which a pivot shaft 19 to be inserted into an insertion hole 18*a* of the connecting unit 18 is fixed, a cover 50 to be attached to the buckle body 40 in an openable manner, a stopper 60 including the wound portion around which the head strap 20 is wound and engagement teeth 61 to be engaged with the plurality of engagement recesses 25 of the head strap 20, and an operating member 70 to be used to operate the stopper 60 for length adjustment of the head strap 20.

Figure 5:
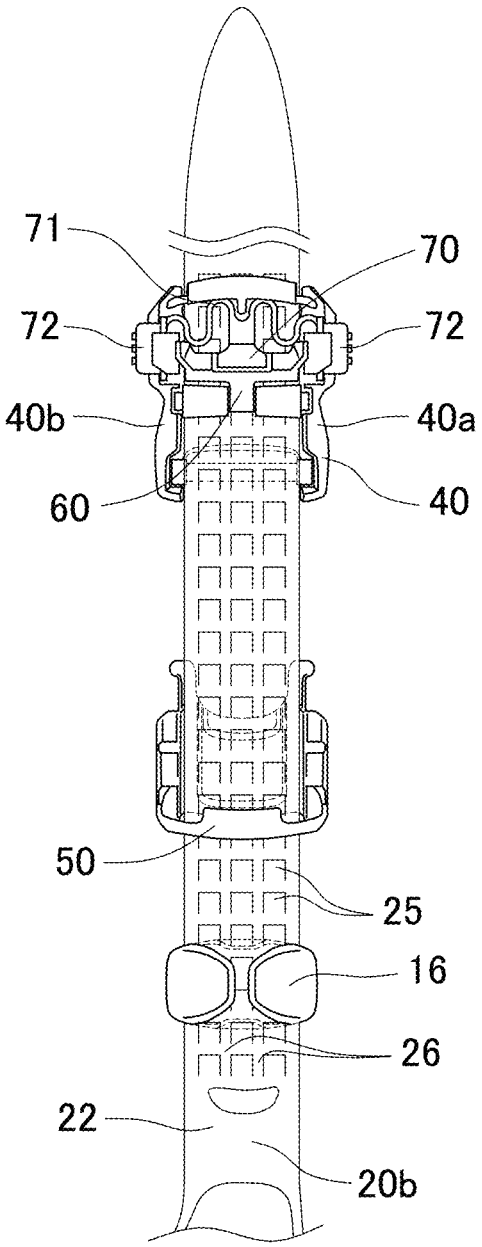
FIG. 5 is an enlarged plan view of the buckle in an open state.

Referring to FIGS. 3 and 5, the buckle body 40 includes both side walls 40*a* and 40*b* opposed to each other in the vertical direction Y and extending in the front-back direction Z, and a bottom wall 40*c* between the side walls 40*a* and 40*b*. Each of the side walls 40*a*, 40*b* includes an arm having a first through hole 41 for inserting the pivot shaft 19, a second through hole 42 for locking a pivot shaft 52 of the cover 50, a third through hole 43 for inserting the wound portion 63, and a fourth through hole 44 for inserting the operating portion 72. Furthermore, the rear end portion of the buckle body 40 includes the outer insertion portion 36 for inserting the distal end portion 22A of the first extending portion 22, a support frame 46 for inserting and fitting a part of the operating member 70, and a portion-to-be-locked 47 configured to be locked in the cover 50.

The cover 50 includes a pair of front arms 51 each including the pivot shaft 52 to be pivotably locked in the second through hole 42 of the buckle body 40, the inner insertion portion 35 disposed behind the pair of front arms 51 for inserting the distal end portion 22A of the first extending portion 22, and a lock projection 53 projecting forward from an opening edge of the inner insertion portion 35. While the pivot shaft 52 of the cover 50 is locked in the second through hole 42 of the buckle body 40, a rear end portion of the cover 50 is pressed against the buckle body 40 so that the lock projection 53 locks the portion-to-be-locked 47 of the buckle body 40. As a result, the cover 50 can be attached to the buckle body 40.

The stopper 60 includes a main body portion 62 including engagement teeth 61 aligned at intervals in the vertical direction Y, and the wound portion 63 disposed in front of the main body portion 62 for reversing the first extending portion 22 of the head strap 20. Both ends of the main body portion 62 each include a slider 64 configured to make sliding contact with an inclined surface 73 defined by an inner surface of the operating portion 72 of the operating member 70.

The wound portion 63 includes a guide shaft 65, and a pair of rotary covers 66 each having a through hole 66*a* in a center. The pair of rotary covers 66 are made of a soft material such as silicone or a soft rubber, and are fitted to both ends of the guide shaft 65 in a detachable manner. The through holes 66*a* in the pair of rotary covers 66 are one size larger than the ends of the guide shaft 65 so that the pair of rotary covers 66 rotate when the first extending portion 22 of the head strap 20 makes sliding contact. This implements smooth pulling operation of the head strap 20.

Each of the pair of rotary covers 66 has a shape narrowing down toward a middle of the guide shaft 65, i.e., a shape tapering off from an outside toward an inside. This prevents the rotary cover 66 from vertically shifting when the rotary cover 66 is rotated by pulling the head strap 20, and allows stable rotation with an inside portion as a fulcrum.

Figure 6A:
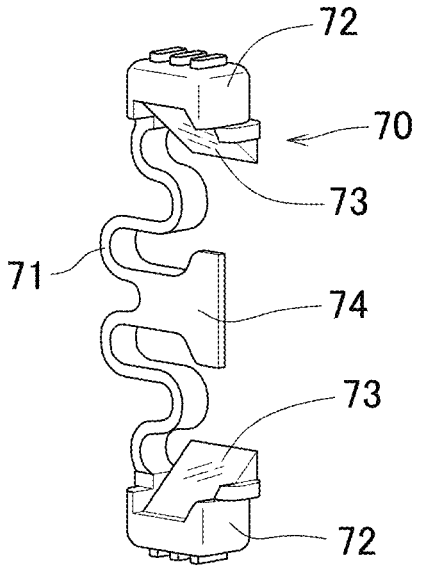
FIG. 6A is an enlarged plan view of an operating member.

Referring to FIGS. 3 and 6A, the operating member 70 includes a spring portion 71 meanderingly extending in the vertical direction Y, and the operating portions 72 disposed on both ends of the spring portion 71, having a plurality of anti-slip protrusions 72*a* on outer surfaces, and configured to be touched with fingers of the wearer. The operating portions 72 each include the inclined (sliding contact) surface 73 in an inclined shape on the inner surface. The spring portion 71 includes a support piece 74 in a middle. When the operating portions 72 are pressed by the wearer with fingers, a gap between the end portions of the spring portion 71 is narrowed down against an expanding action, and when pressing is released, the spring portion 71 is restored.

Figure 6B:
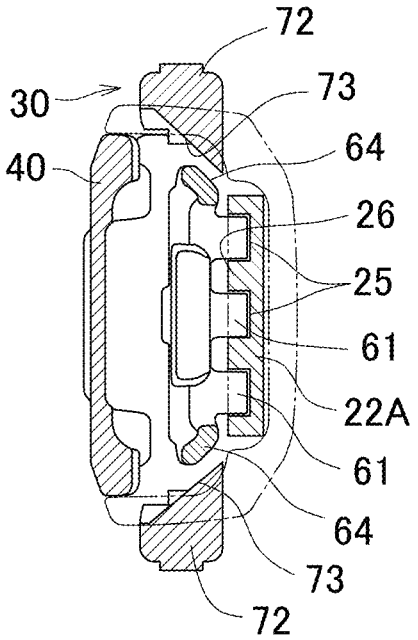
FIG. 6B is a cross-sectional view taken along line VI(b)-VI (b) in FIG. 1 in a locked state.

Referring to FIGS. 5, 6B, and 7A, when the head strap 20 is attached to the buckle 30, the engagement teeth 61 of the stopper 60 is engaged with the engagement recesses 25 in the distal end portion 22A of the head strap 20.

Figure 6C:
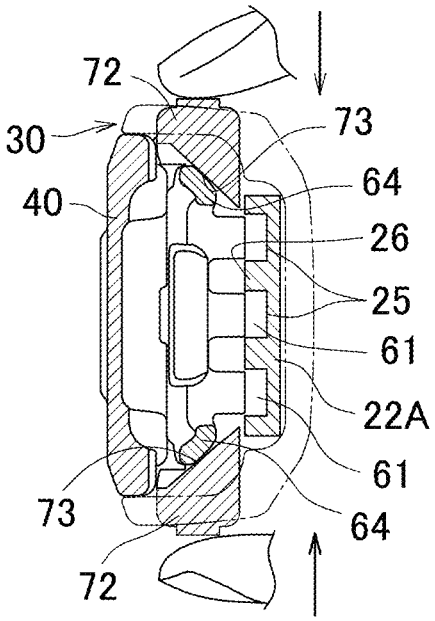
FIG. 6C is a view similar to FIG. 6B in an unlocked state.
Figure 7B:
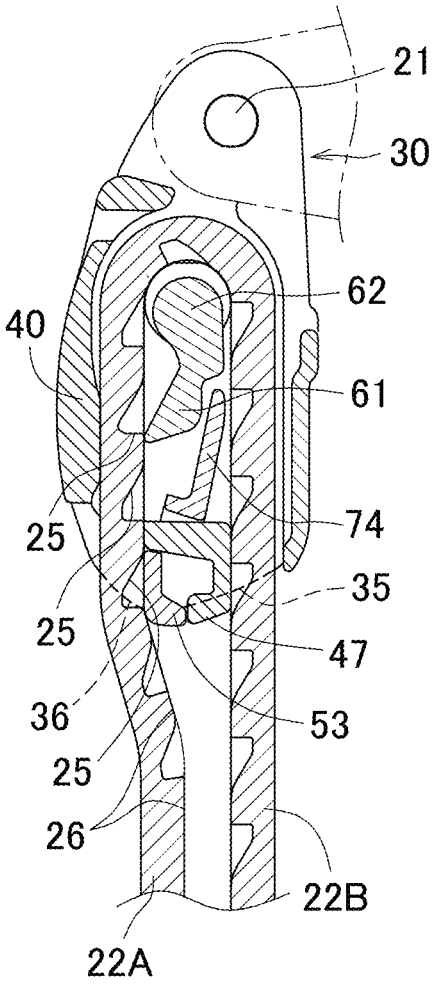
FIG. 7B is a view similar to FIG. 7A in an unlocked state.

Referring to FIGS. 6C and 7B, when the operating portions 72 are pressed in such a state, the sliders 64 of the stopper 60 slide on the inclined surfaces 73 to move inward. That is, the stopper 60 moves in a direction separating from the distal end portion 22A, so that the engagement between the engagement teeth 61 and the engagement recesses 25 is released. When the wearer pulls the distal end portion 22A to move the figure eight ring 16 in such a state, the length of the head strap 20 can be freely adjusted.

In conventional swimming masks, the wound portion for the head strap is disposed at a rear end edge portion of the buckle to be exposed outside, and thus the hair of the wearer may enter and be entangled between the wound portion and the head strap. According to the present invention, the wound portion 63 for the head strap 20 is disposed in the intermediate portion 32 of the buckle 30, and in front of a means for restricting the movement of the head strap 20, i.e., the ratchet mechanism including the engagement teeth 61 and the engagement recesses 25. This can effectively prevent the hair of the wearer from easily reaching the wound portion 63 and being entangled with the wound portion 63.

Furthermore, the head strap 20 does not include a plurality of engagement teeth projecting from the inner surface 20*a* or the outer surface 20*b*, and the outer surface 20*b* is flat with the flat portions 26. Thus, referring to FIG. 2B, in a view of the buckle 30 seen from behind, a gap is hardly formed between opening edges of the inner insertion portion 35 and outer insertion portion 36 of the buckle 30 and the head strap 20, and the wound portion 63 cannot be seen from outside. That is, since the wound portion 63 is disposed inside the buckle 30 to be completely covered without being exposed outside, the hair can be further prevented from entering the buckle 30 to be entangled with the wound portion 63.

Furthermore, in the conventional swimming masks, the reversed head strap redundantly slackens in a curved shape at the wound portion. With the wound portion disposed at the rear end of the buckle, a redundant portion of the head strap can be seen, and thus appearance is degraded. In the swimming mask 10 according to the present invention, the wound portion 63 is disposed inside the intermediate portion 32 of the buckle 30, so that the redundancy at the wound portion 63 is not seen from outside. Furthermore, the distal end portion 22A and the base end portion 22B are inserted into the outer insertion portion 36 and the inner insertion portion 35, respectively, so that the head strap does not redundantly slacken, but linearly extends rearward to give a neat impression.

If the engagement recesses 25 of the head strap 20 are formed in the inner surface 20*a* that faces the face of the wearer, the hair may be entangled in the engagement recesses 25 to be brought into the buckle 30. However, according to the present invention, the engagement recesses 25 are formed in the outer surface 20*b* so as to be disposed in the mutually opposing surfaces of the distal end portion 22A and base end portion 22B.

This can effectively prevent the entanglement of the hair in the engagement recesses 25. Furthermore, as described above, the ratchet mechanism includes the plurality of engagement recesses 25 and the plurality of engagement teeth 61, so that the engagement in the front-back direction Z and the vertical direction Y can be stabilized, compared with a case where the ratchet mechanism includes a single engagement recess 25 and a single engaging tooth 61.

Furthermore, in the head strap 20, the outer surface 20*b* includes the engagement recesses 25 in a concave shape instead of the engagement teeth projecting from the outer surface 20*b*, and the flat portion 26 among the engagement recesses 25 makes sliding contact with the wound portion 63. As a result, when the length of the head strap 20 is adjusted, the head strap 20 can be pulled smoothly without shaking. In order to implement such smooth sliding contact by the flat portion 26, the engagement recesses 25 are preferably disposed discontinuously at intervals not only in one of the width direction and length direction, but in both the width direction and length direction of the head strap 20, as shown in the drawings.

Referring to FIG. 4A again, each of the engagement recesses 25 has a bottom, and an end edge 25*b* of the recess on a side of the distal end is deeper than an end edge 25*a* on a side of the center portion 21. A bottom surface 25*c* inclines upward from the end edge 25*a* toward the end edge 25*b* and from a side of the outer surface 20*b* toward a side of the inner surface 20*a*. As shown in FIG. 7A, with the bottom surfaces 25*c* of the engagement recesses 25 in such a shape, the engagement teeth 61 can easily enter the recesses from the end edges 25*a* of the engagement recesses 25, whereas the engagement is not easily released since distal ends of the engagement teeth 61 contact the end edges 25*b* of the engagement recesses 25 after entering the recesses.

Figure 8A:
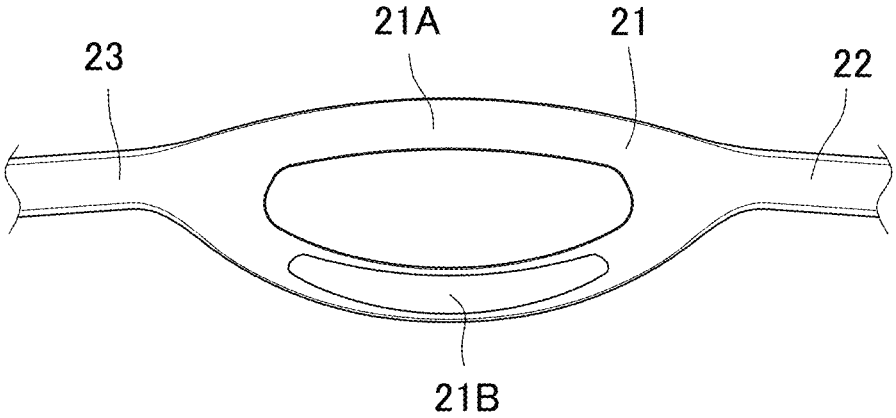
FIG. 8A is an enlarged plan view of a center portion of the head strap.

Referring to FIG. 8A, the bifurcated center portion 21 of the head strap 20 includes an upper portion 21A and a lower portion 21B. A length dimension of the upper portion 21A is smaller than a length dimension of the lower portion 21B. Specifically, the lower portion 21B largely curves outward compared with the upper portion 21A, and thus the length dimension of the lower portion 21B is larger than the length dimension of the upper portion 21A. As a result, even when the back of the head of the wearer has a shape that a lower part is more protruding than an upper part, the lower portion 21B having a relatively long length allows the head strap 20 to fit the shape of the head.

In addition, a thickness dimension of the upper portion 21A is smaller than a thickness dimension of the lower portion 21B, and thus the upper portion 21A is more stretchable along the head of the wearer than the lower portion 21B.

Figure 8B:
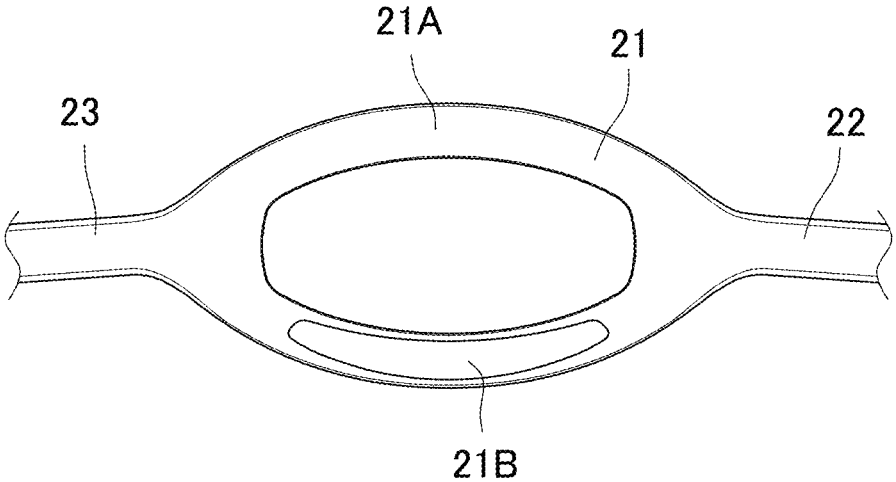
FIG. 8B is a view similar to FIG. 8A when the head strap is pulled in a length direction.

Referring to FIG. 8B, for example, when the back of the head of the wearer has a shape that the upper part is more protruding than the lower part, the upper portion 21A stretches to have the length dimension similar to the length dimension of the lower portion 21B in a wearing state so as to allow the head strap 20 to fit the shape of the head. As a result, since the upper portion 21A and lower portion 21B of the center portion 21 have different configurations and can change the shapes according to the shapes of the heads, the head strap 20 can fit the backs of the heads of various shapes.

Figure 9A:
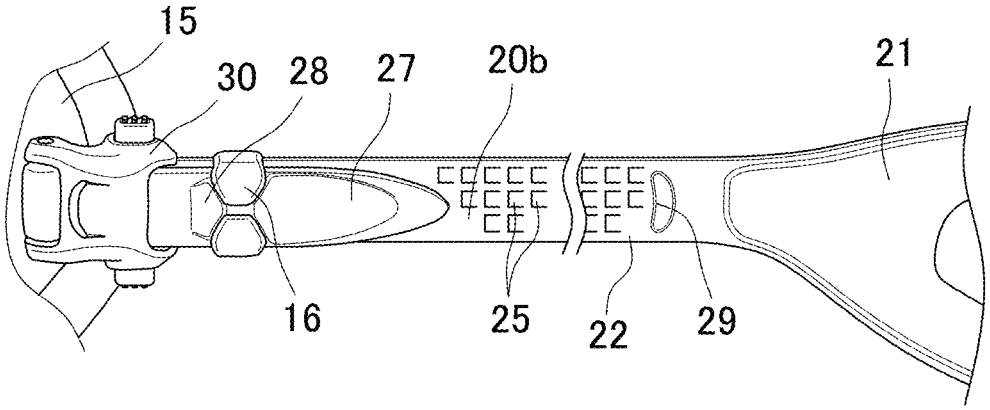
FIG. 9A is an enlarged partial view of the head strap.
Figure 9B:
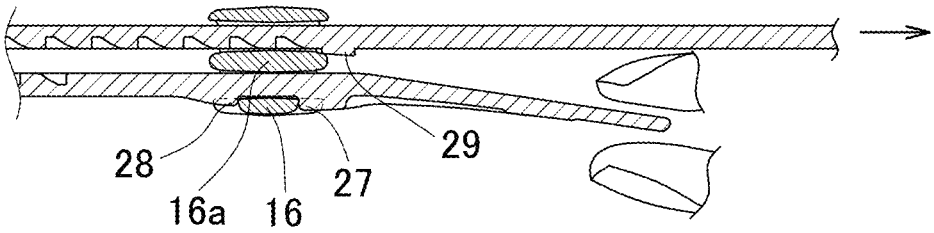
FIG. 9B is a cross-sectional view when a figure eight ring is disposed at protrusions.

Referring to FIG. 9A, the head strap 20 includes a third protrusion 29 on the outer surface 20*b* of the first extending portion 22. Assume that the figure eight ring 16 is disposed between the first protrusion 27 and the second protrusion 28 of the distal end portion 22A, and the engagement of the ratchet mechanism is released by pressing the operating portions 72 of the buckle 30. When the wearer holds the distal end portion 22A of the head strap 20 and pulls it rearward in such a state, the figure eight ring 16 reaches the third protrusion 29. The figure eight ring 16 is disposed between the first protrusion 27 and the second protrusion 28 so that the figure eight ring 16 is restricted from moving in the length direction of the head strap 20 so as to be positioned.

When the figure eight ring 16 is about to reach the third protrusion 29, a wall portion 16*a* of the figure eight ring 16 located between the distal end portion 22A and the base end portion 22B contacts the third protrusion 29 to be restricted from moving rearward. Accordingly, at the moment when the wearer releases the distal end portion 22A from the fingers, the head strap 20 is released from the tensile force, and resilience of the head strap 20 moves the figure eight ring 16 forward. It can be said that the swimming mask 10 includes an automatic return system for automatically returning the figure eight ring 16 forward by pulling the figure eight ring 16 up to the third protrusion 29.

Various known materials generally used in this kind of field can be used without limitation for constituent materials included in the swimming mask 10, unless otherwise described in this specification. Terms such as "first", "second", or "third" used in this specification are used simply to distinguish similar elements, positions, or the like.

What is claimed is:

1. A swimming mask having a front-back direction and a lateral direction, the swimming mask comprising:

a mask body having a lens frame and a skirt extending rearward from the lens frame;

a buckle attached to a connector disposed on at least one of both sides of the mask body; and a head strap configured to be connected to the mask body via the buckle, wherein the buckle and the head strap are connected by a ratchet mechanism including a plurality of engagement teeth of the buckle and a plurality of engagement recesses of the head strap, the buckle includes:

a front end portion attached to the connector, a rear end portion including an insertion portion in which the head strap is inserted, an intermediate portion between the front end portion and the rear end portion, a stopper including:

a wound portion around which the head strap is wound in a reversible manner, and the plurality of engagement teeth configured to be engaged with the plurality of engagement recesses of the head strap, and an operator configured to operate the stopper for length adjustment of the head strap, and the stopper is disposed inside the intermediate portion and is not exposed outside.

2. The swimming mask according to claim 1, wherein the plurality of engagement recesses is disposed on an outer surface of the head strap, not on a face side of a wearer in a wearing state.

3. The swimming mask according to claim 1, wherein the stopper further includes a main body portion, and sliders on two ends of the main body portion, the operator includes operating portions separated in a vertical direction, and inclined surfaces disposed on undersurfaces of the operating portions and the sliders on the two ends of the main body portion are configured to make sliding contact to cause the stopper to move in a direction separating from the head strap to release engagement of the ratchet mechanism.

4. The swimming mask according to claim 1, wherein the wound portion is disposed in front of the ratchet mechanism in the front-back direction of the swimming mask.

5. The swimming mask according to claim 1, wherein the buckle includes a buckle body and a cover configured to be attached to the buckle body in an openable manner, and the cover covers the stopper from being exposed outside.

6. The swimming mask according to claim 1, wherein the wound portion includes a guide shaft, and a pair of rotary covers fitted to two ends of the guide shaft in a detachable manner.

7. The swimming mask according to claim 6, wherein each of the pair of rotary covers is configured to rotate in response to a portion of the head strap sliding on while contacting the pair of rotary covers.

8. The swimming mask according to claim 6, wherein each of the pair of rotary covers has a shape narrowing down toward a middle of the guide shaft.

9. The swimming mask according to claim 8, wherein each of the pair of rotary covers is configured to rotate in response to a portion of the head strap sliding on while contacting the pair of rotary covers.

10. The swimming mask according to claim 9, wherein the plurality of engagement recesses is disposed on an outer surface of the head strap, not on a face side of a wearer in a wearing state.

11. The swimming mask according to claim 10, wherein the stopper further includes a main body portion having the plurality of engagement teeth, and sliders on two ends of the main body portion, the operator includes operating portions separated in a vertical direction, and inclined surfaces disposed on undersurfaces of the operating portions and the sliders on the two ends of the main body portion are configured to make sliding contact to cause the stopper to move in a direction separating from the head strap to release engagement of the ratchet mechanism.

12. The swimming mask according to claim 11, wherein in response to movements of the operating portions in the vertical direction, the stopper is caused to move in a direction away from the head strap, while the sliders are in sliding contact with the inclined surfaces of the operating portions, to release the engagement of the ratchet mechanism.

13. The swimming mask according to claim 12, wherein the wound portion is disposed in front of the ratchet mechanism in the front-back direction of the swimming mask.

14. The swimming mask according to claim 13, wherein the buckle includes a buckle body and a cover configured to be attached to the buckle body in an openable manner, and the cover covers the stopper from being exposed outside.

* * * * *